US012331990B2

(12) United States Patent
Zhang et al.

(10) Patent No.: US 12,331,990 B2
(45) Date of Patent: Jun. 17, 2025

(54) MULTI-FUNCTIONAL DOUBLE-LAYER CRISPER

(71) Applicant: Hebei Fenger Intelligent Technology Co., Ltd, Shijiazhuang (CN)

(72) Inventors: Jianzhong Zhang, Handan (CN); Xiaojia Liu, Handan (CN)

(73) Assignee: Hebei Fenger Intelligent Technology Co., Ltd, Shijiazhuang (CN)

( * ) Notice: Subject to any disclaimer, the term of this patent is extended or adjusted under 35 U.S.C. 154(b) by 241 days.

(21) Appl. No.: 18/095,013

(22) Filed: Jan. 10, 2023

(65) Prior Publication Data

US 2023/0160622 A1 May 25, 2023

(51) Int. Cl.
*F25D 3/08* (2006.01)
*F25D 23/06* (2006.01)

(52) U.S. Cl.
CPC ..... *F25D 3/08* (2013.01); *F25D 23/069* (2013.01); *F25D 2201/10* (2013.01); *F25D 2303/08221* (2013.01); *F25D 2303/08222* (2013.01); *F25D 2303/0845* (2013.01)

(58) Field of Classification Search
CPC ..... A47G 19/00; A47G 19/26; F25D 3/08; F25D 2201/10; F25D 2303/08221; F25D 2303/08222; F25D 2303/0845; A47J 39/006
See application file for complete search history.

(56) References Cited

U.S. PATENT DOCUMENTS

2005/0156494 A1 7/2005 Bergmann et al.
2010/0006579 A1* 1/2010 Roth ..... A47J 39/006 220/592.2
2015/0136793 A1* 5/2015 Smyers ..... A47G 19/02 220/795
2015/0210464 A1* 7/2015 Carroll ..... F25D 3/08 220/592.21
2018/0038630 A1 2/2018 Biotti et al.
2019/0039811 A1* 2/2019 Kuhn ..... B65D 81/3834
2019/0293342 A1 9/2019 Butenhoff et al.
2020/0172290 A1* 6/2020 Serrahima ..... A47J 39/006
2021/0330107 A1* 10/2021 Strub ..... A47G 19/26

FOREIGN PATENT DOCUMENTS

CN 209160426 U * 7/2019

OTHER PUBLICATIONS

18095013_2024-11-01_CN_209160426_U_M.pdf (Year: 2019).*

* cited by examiner

*Primary Examiner* — Frantz F Jules
*Assistant Examiner* — Martha Tadesse
(74) *Attorney, Agent, or Firm* — Hemisphere Law, PLLC; Zhigang Ma

(57) ABSTRACT

The present invention relates to a multi-functional double-layer crisper, comprising a bottom box body, a sandwich box body and a cover body; the edge of the opening end of the bottom box body is protruded outwards to form an annular flange; the edge of the bottom end of the sandwich box body is protruded outwards to form an annular clamp plate which is hermetically abutted with the annular flange; the sandwich box body is internally provided with vertical partition plates, the bottom end face of the sandwich box body is concave inwards to form a containing groove, and an insulation ice box is clamped in the containing groove; the inner part of the cover body is a cavity. The present invention can be used for storing food in layers and zones, and has good effects of cooling and fresh-keeping when used in summer.

9 Claims, 10 Drawing Sheets

MULTI-FUNCTIONAL DOUBLE-LAYER CRISPER

TECHNICAL FIELD

The present invention relates to the technical field of crispers, and particularly relates to a multi-functional double-layer crisper.

BACKGROUND

The crisper is a storage box that can play a role of fresh-keeping. In general, the existing crisper has three types: one is a plastic crisper, which is made of resin, with the general temperature resistance range of the maximum temperature of 120° C. to the minimum temperature of −20° C.; one is a toughened glass crisper, which is made of ordinary toughened glass; and the last one is a heat resistant glass crisper, which is made of high borosilicate glass material.

The crisper is convenient and practical, and also can be used for storing food by different categories. The prior art increases the capacity by the arrangement of a double-layer crisper. For example, a patent for present invention with the patent No. of CN209160426U discloses a double-layer crisper with strong fresh keeping capacity, which provides a variety of storage methods for users through the roles of a high boron glass crisper and a PP sandwich box. However, the high boron glass crisper, the PP sandwich box and the box cover are installed in sequence, so the integrity of the shape and structure is poor; the PP sandwich box has no partition structure, which is still inconvenient to store a variety of food such as dishes; and especially when carried outside in summer, the structure of the crisper cannot play a very good role of fresh keeping due to hot weather, and the application range of the crisper is limited.

Therefore, the problem to be urgently solved by those skilled in the art is how to provide a multi-functional double-layer crisper which can meet the needs of use in zones and layers and still has the effects of cooling and fresh keeping when used in summer.

SUMMARY

The technical problem to be solved by the present invention is to provide a multi-functional double-layer crisper which can be used for storing food in zones and layers and also has good effects of cooling and fresh keeping when used in summer.

A technical solution adopted to solve the above technical problem in the present invention is as follows:

A multi-functional double-layer crisper, comprising a bottom box body, a sandwich box body and a cover body; the top end of the bottom box body is open, and the edge of the opening end is protruded outwards to form an annular flange; the top end of the sandwich box body is open, the edge of the bottom end is protruded outwards to form an annular clamp plate, and the lower end face of the annular clamp plate is hermetically abutted with the upper end face of the annular flange; the sandwich box body is internally provided with partition plates vertical to the bottom wall and divided into independent containing cavities, the outer bottom end face of the sandwich box body is concave inwards to form a containing groove, and an insulation ice box is clamped in the containing groove; the inner part of the cover body is a cavity with an opening on the bottom end, and the outer edge of the opening end is hinged with a plurality of knuckles along the circumferential direction; the cavity of the cover body is buckled on the outer side of the sandwich box body, the opening end face is abutted with the upper end face of the annular clamp plate, and the inner top surface of the cavity of the cover body is hermetically abutted with the opening end face of the sandwich box body; and each knuckle is provided with first clamping plates and second clamping plates arranged up and down at intervals, and the first clamping plates and the second clamping plates can be clamped and fixed with the annular flange.

The present invention has the following beneficial effects: the sandwich box body is located between the bottom box body and the cover body and located in the cavity of the cover body, the cover body and the bottom box body are clamped through the knuckles to limit and fix the annular clamp plate of the sandwich box body, and the annular clamp plate is fixed between the cover body and the bottom box body, so the whole crisper has strong shape integrity and is more beautiful; the bottom box body and the sandwich box body are arranged at different layers to store different kinds of food, and sealing structures are arranged between the sandwich box body and the bottom box body and between the sandwich box body and the cover body to form enclosed space in the two box bodies, which is conducive to the storage of food; the inner part of the sandwich box body is divided into independent containing cavities by the vertical partition plates, which meets the need of storing different kinds of food through partition arrangement, the containing groove on the bottom end of the sandwich box body is clamped with the insulation ice box, ice blocks are stored in the insulation ice box, which can not only cool the food in the bottom box body and keep such food fresh, but also cool the food in the sandwich box body and keep such food fresh through the bottom plate of the sandwich box body, so as to cool the inner space of the bottom box body and the sandwich box body simultaneously, and can be applied to the need of keeping the stored food fresh when carried outside in summer; and the spacing between the first clamping plates and the second clamping plates of each knuckle is so that the cover body can be clamped with the bottom box body through the second clamping plates when the sandwich box body is installed and the cover body can be clamped with the bottom box body through the first clamping plate when no sandwich box body is installed.

On the basis of the above technical solution, the present invention can also be improved as follows:

Further, the position of the bottom end face of the sandwich box body near the edge is protruded downwards to form a plurality of limiting plates.

The above further solution has the following beneficial effects: the limiting plates extend downwards vertical to the bottom end face of the sandwich box body, and when the sandwich box body is installed, the limiting plates on the bottom end of the sandwich box body are located in the bottom box body, which can play a role of horizontal limiting, so as to prevent the sandwich box body from falling out of position when installed or placed above the bottom box body.

Further, the position of the outer edge of the opening end of the cover body corresponding to each knuckle is protruded outwards to form a raised clamping structure; and the raised clamping structure comprises a first bump, a second bump and a third bump, the second bump has an L-shaped section and is located between the first bump and the third bump, two articulated grooves are limited between the second bump and the first bump and between the second bump and the third bump, articulated shafts are respectively installed in the articulated grooves, and the knuckles are hinged with the articulated shafts.

The above further solution has the following beneficial effects: one end of the second bump away from the cover body is integrally connected with a positioning plate bending and extending downwards, and when the cover body is buckled on the sandwich box body, the positioning plate plays a role of limiting to prevent misalignment between the cover body and the sandwich box body; and the knuckles are detachably hinged with the two articulated shafts arranged at intervals for more flexible rotation.

Further, each knuckle comprises articulated parts and a connecting plate, each articulated part has a ring structure with the section greater than a ½ circle, and the lower end of each articulated part is integrally connected with the connecting plate extending downwards; the positions of the articulated parts and the connecting plate corresponding to the second bump are concave to form an avoidance groove, and the articulated parts on both sides of the avoidance groove are respectively sleeved and hinged with the two articulated shafts; and the inner side of the connecting plate is integrally connected with the first clamping plates and the second clamping plates arranged up and down at intervals.

The above further solution has the following beneficial effects: the opening end of the ring of each articulated part faces downward, one side of the opening end is integrally connected with the top end of the connecting plate, the ring of each articulated part is sleeved on the articulated shaft and assembled or dissembled from the opening of the ring, and the articulated part, the first clamping plates and the second clamping plates are located on the same side of the connecting plate; and the shape integrity of matching of the avoidance groove and the second bump is strong, and each articulated part is divided into two parts by the avoidance groove.

Further, the upper end faces of the first clamping plates and the second clamping plates are protruded to form buckles, and the lower end face of the annular flange is concave to form clamping grooves matched with the buckles.

The above further solution has the following beneficial effects: the first clamping plates and the second clamping plates are matched and clamped with the clamping grooves of the annular flange through the buckles, and the first clamping plates and the second clamping plates can have a segmented structure, i.e., two first clamping blocks can be provided and arranged at intervals in a segmented manner, and two second clamping blocks can be provided and arranged at intervals in a segmented manner, which is convenient to be clamped with the annular flange.

Further, a first sealing groove is formed on the lower end face of the annular clamp plate, and a seal ring is installed in the first sealing groove and hermetically abutted with the upper end face of the annular flange; and a second sealing groove is formed on the inner top surface of the cavity of the cover body, and a seal ring is installed in the second sealing groove and hermetically abutted with the opening end face of the sandwich box body.

The above further solution has the following beneficial effects: enclosed space is formed in the bottom box body and the sandwich box body through the seal rings, which is conductive to the storage, insulation and fresh keeping of food.

Further, the partition plates comprise an annular partition plate and rectangular partition plates, the vertically arranged annular partition plate is installed in the inner middle position of the sandwich box body, the plurality of vertically arranged rectangular partition plates are installed along the circumferential direction between the outer wall of the annular partition plate and the inner wall of the sandwich box body, and the inner part of the sandwich box body is divided into the plurality of containing cavities by the annular partition plate and the rectangular partition plates; and a seasoning box is installed in the annular partition plate.

The above further solution has the following beneficial effects: the containing cavity in the annular partition plate is used for placing the seasoning box, the containing cavities between the rectangular partition plates are used for storing different kinds of food, and the partition design is adopted to meet the need of storing a variety of food.

Further, the middle part of the bottom surface of the containing groove is protruded downwards to form a clamping block, the middle part of the insulation ice box is provided with a clamping hole penetrating the insulation ice box, and the outer wall of the clamping block is clamped and fixed with the inner wall of the clamping hole; and the peripheral edge of the insulation ice box is concave inwards to form a curved groove.

The above further solution has the following beneficial effects: a first clamping bump is protruded from the inner wall of the clamping hole of the insulation ice box, a second clamping bump is protruded from the outer wall of the clamping block, and the first clamping bump is matched and clamped with the second clamping bump so that the insulation ice box can be removed for cleaning or adding ice blocks; and the curved groove of the insulation ice box is the hand-hold part, which is convenient for assembly and disassembly operation.

Further, the bottom box body is made of high borosilicate glass material, and the sandwich box body and the cover body are made of PP material.

The above further solution has the following beneficial effects: the bottom box body is a transparent box body, and the PP material of the sandwich box body and the cover body is an environment-friendly and heat-resistant material, which can be put in a microwave oven for heating the stored food.

Further, the sections of the bottom box body, the sandwich box body and the cover body along the horizontal direction all have a rectangular or circular structure.

The above further solution has the following beneficial effects: the crisper can be circular or rectangular, and the corresponding insulation ice box has a matched circular or rectangular structure.

It can be known from the above technical solutions that compared with the prior art, the present invention has the following beneficial effects:

(1) The multi-functional double-layer crisper of the present invention adopts the layered and partition design to meet the use need of storing a variety of food; the annular flange of the bottom box body and the annular clamp plate of the sandwich box body are sealed by the seal ring, and the opening end of the sandwich box body and the inner top surface of the cover body are sealed by the seal ring, so that enclosed space is formed in the bottom box body and the sandwich box body, which is conducive to the storage and fresh keeping of food; and the inner part of the sandwich box body is divided into the plurality of independent containing cavities by the annular partition plate and the rectangular partition plates for storing different kinds of food through partition arrangement, and the containing cavity in the annular partition plate can be used for placing the seasoning box, which is convenient to use;

(2) In the present invention, the food stored in the bottom box body and the sandwich box body is cooled and kept fresh through the insulation ice box, which is applicable for storage and fresh keeping of food when carried outside in summer; and the insulation ice box is clamped in the containing groove on the bottom end of the sandwich box body, which can not only cool the food stored in the bottom box body and keep such food fresh through heat transfer, but also cool the food stored in the sandwich box body and keep such food fresh through heat transfer by fitting with the bottom plate of the sandwich box body, so as to provide good effect of fresh keeping.

(3) In the present invention, the sandwich box body is located above the bottom box body, and the cavity of the cover body is buckled on the sandwich box body, i.e., the annular clamp plate for fixing the sandwich box body is arranged between the bottom box body and the cover body, and the sandwich box body is located in the cavity of the cover body, so the shape integrity is strong.

Figure 1:
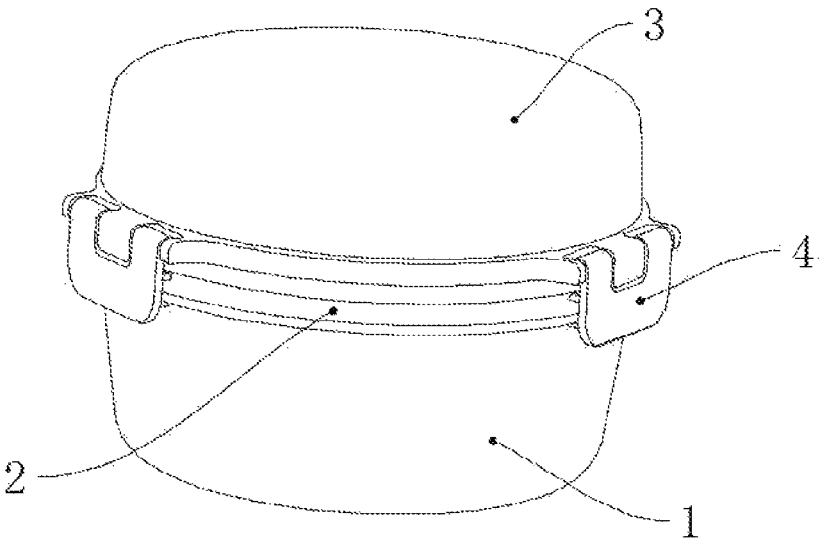
FIG. 1 is an integral structural schematic diagram of a multi-functional double-layer crisper of the present invention.

A list of components represented by legends in the figures is as follows:

1—bottom box body; 2—sandwich box body; 3—cover body; 4—knuckle; 5—insulation ice box; 6—seasoning box; 7—seal ring; 11—annular flange; 21—annular clamp plate; 22—containing groove; 23—first sealing groove; 24—annular partition plate; 25—clamping block; 26—rectangular partition plate; 27—limiting plate; 31—first bump; 32—second bump; 33—third bump; 34—articulated shaft; 41—articulated part; 42—connecting plate; 43—first clamping plate; and 44—second clamping plate.

DETAILED DESCRIPTION

The principles and features of the present invention will be described below in combination with drawings. Described examples are only used for explaining the present invention, but are not intended to limit the scope of the present invention.

As shown in FIG. 1 to FIG. 10, embodiments of the present invention disclose a multi-functional double-layer crisper, comprising: a bottom box body 1, wherein the top end of the bottom box body 1 is open, and the edge of the opening end is protruded outwards to form an annular flange 11; a sandwich box body 2, wherein the top end of the sandwich box body 2 is open, the edge of the bottom end is protruded outwards to form an annular clamp plate 21, and the lower end face of the annular clamp plate 21 is hermetically abutted with the upper end face of the annular flange 11; the sandwich box body 2 is internally provided with vertical partition plates and divided into independent containing cavities, the outer bottom end face of the sandwich box body 2 is concave inwards to form a containing groove 22, and an insulation ice box 5 is clamped in the containing groove 22; a cover body 3, wherein the inner part of the cover body 3 is a cavity with an opening on the bottom end, and the outer edge of the opening end is hinged with a plurality of knuckles 4 along the circumferential direction; the cavity of the cover body 3 is buckled on the outer side of the sandwich box body 2, the opening end face is abutted with the upper end face of the annular clamp plate 21, and the inner top surface of the cavity of the cover body 3 is hermetically abutted with the opening end face of the sandwich box body 2; and each knuckle 4 is provided with first clamping plates 43 and second clamping plates 44 arranged up and down at intervals, and the first clamping plates 43 and the second clamping plates 44 can be matched and clamped with the annular flange 11. The opening end face of the bottom box body 1 is the top end face thereof, the opening end face of the sandwich box body 2 is the top end face thereof, and the opening end face of the cover body 3 is the bottom end face thereof.

Figure 6:
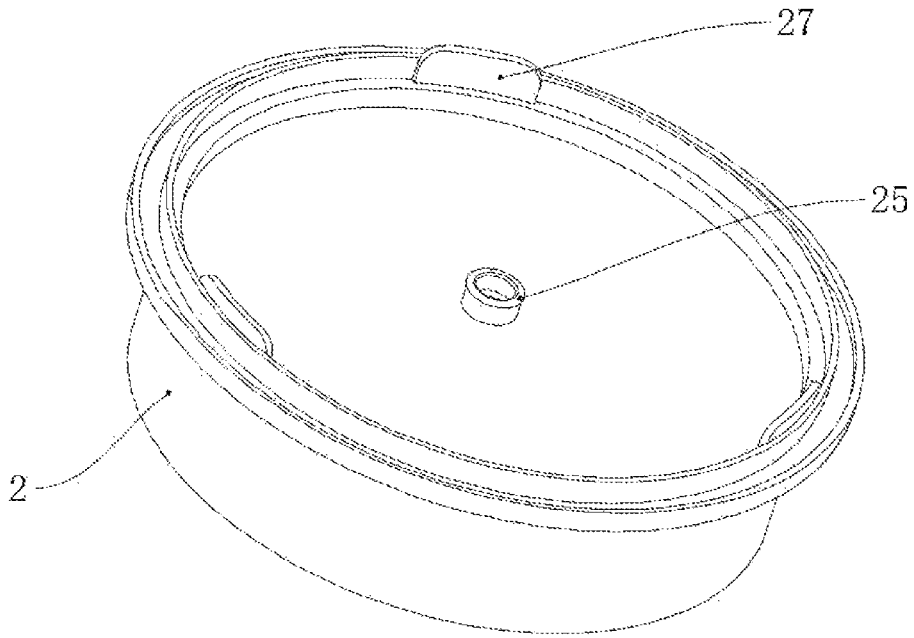
FIG. 6 is a bottom stereographic view of a sandwich box body of a multi-functional double-layer crisper of the present invention.

To further optimize the above technical solution, as shown in FIG. 6, the position of the bottom end face of the sandwich box body 2 near the edge is protruded downwards to form a plurality of limiting plates 27.

Figure 7:
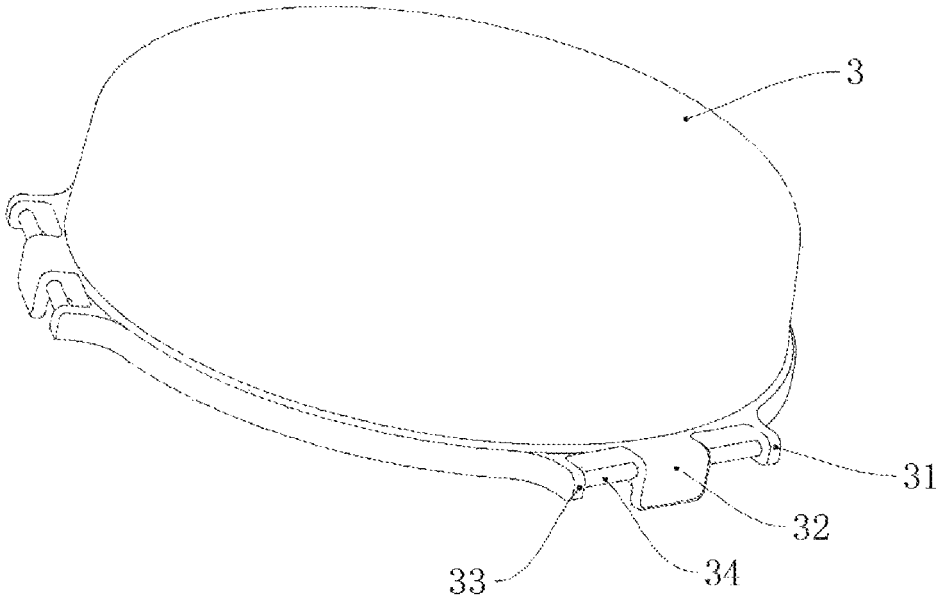
FIG. 7 is a structural schematic diagram of a cover body of a multi-functional double-layer crisper of the present invention.

To further optimize the above technical solution, as shown in FIG. 7, the position of the outer edge of the opening end of the cover body 3 corresponding to each knuckle 4 is protruded outwards to form a raised clamping structure; and the raised clamping structure comprises a first bump 31, a second bump 32 and a third bump 33, the second bump 32 has an L-shaped section and is located between the first bump 31 and the third bump 33, two articulated grooves are limited between the second bump 32 and the first bump 31 and between the second bump 32 and the third bump 33, articulated shafts 34 are respectively installed in the articulated grooves, and the knuckles 4 are hinged with the articulated shafts 34.

Figure 8:
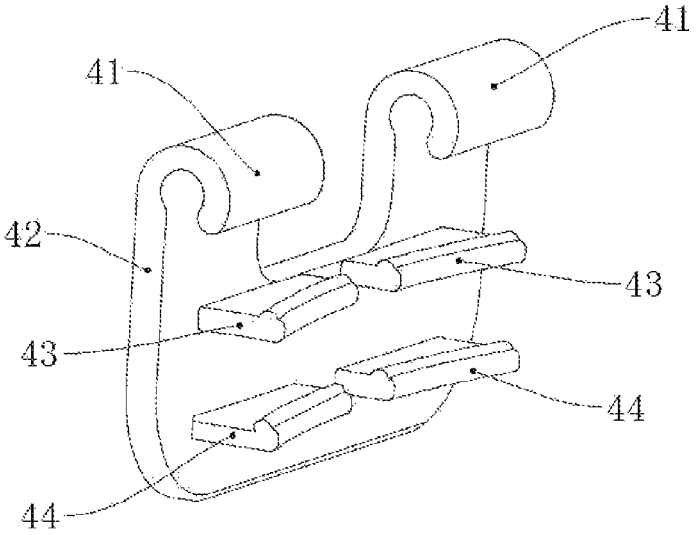
FIG. 8 is a structural schematic diagram of a knuckle of a multi-functional double-layer crisper of the present invention.

To further optimize the above technical solution, as shown in FIG. 8, each knuckle 4 comprises articulated parts 41 and a connecting plate 42, each articulated part 41 has a ring structure with the section greater than a ½ circle, and the lower end of each articulated part 41 is integrally connected with the connecting plate 42 extending downwards; the positions of the articulated parts 41 and the connecting plate 42 corresponding to the second bump 32 are concave to form an avoidance groove, and the articulated parts 41 on both sides of the avoidance groove are respectively sleeved and hinged with the two articulated shafts 34; and the inner side of the connecting plate 42 is integrally connected with the first clamping plates 43 and the second clamping plates 44 arranged up and down at intervals. The first clamping plates 43 and the second clamping plates are vertical to the inner side of the connecting plate 41. The opening end of the ring structure of the articulated part 41 faces downward.

To further optimize the above technical solution, the upper end faces of the first clamping plates 43 and the second clamping plates 44 are protruded to form buckles, and the lower end face of the annular flange 11 is concave to form clamping grooves matched with the buckles.

Figure 3:
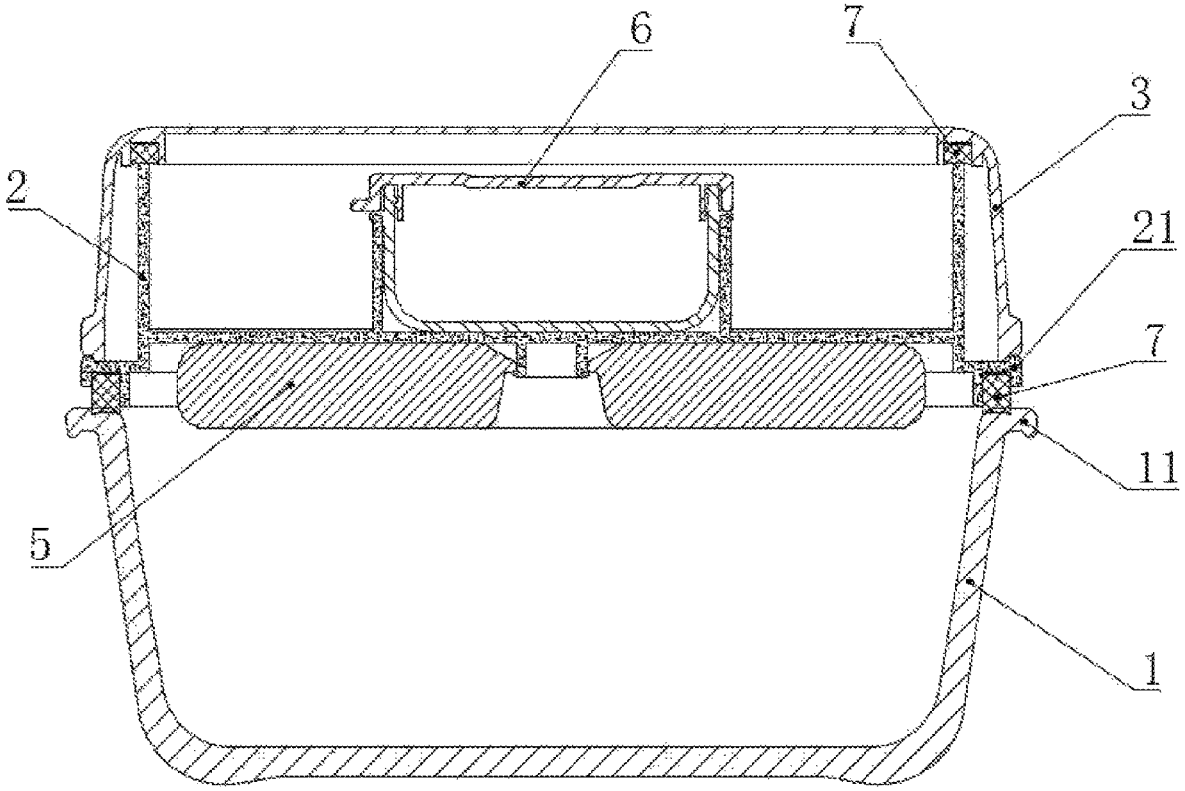
FIG. 3 is a sectional view of a multi-functional double-layer crisper of the present invention.
Figure 4:
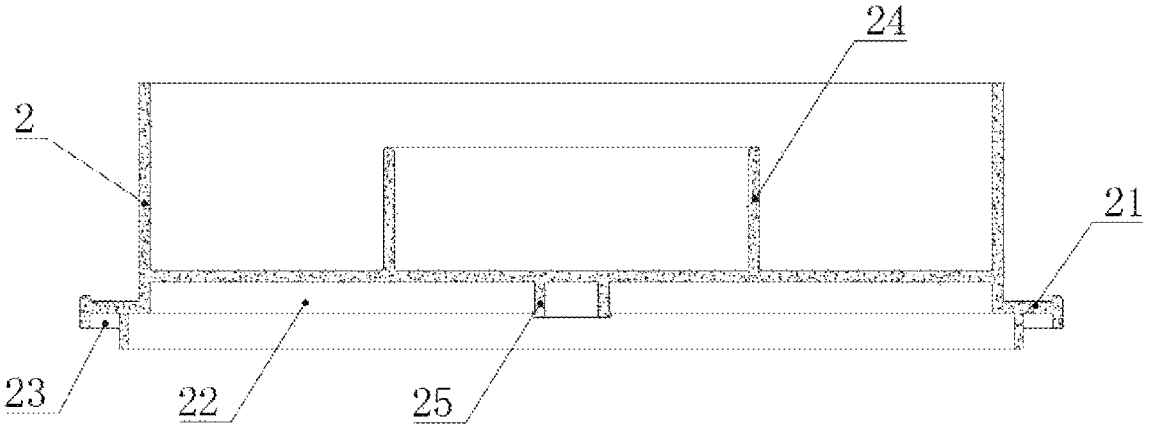
FIG. 4 is a sectional view of a sandwich box body of a multi-functional double-layer crisper of the present invention.

To further optimize the above technical solution, as shown in FIG. 3 and FIG. 4, a first sealing groove 23 is formed on the lower end face of the annular clamp plate 21, and a seal ring 7 is installed in the first sealing groove 23 and hermetically abutted with the upper end face of the annular flange 11; and a second sealing groove is formed on the inner top surface of the cavity of the cover body 3, and a seal ring 7 is installed in the second sealing groove and hermetically abutted with the opening end face of the sandwich box body 2.

Figure 5:
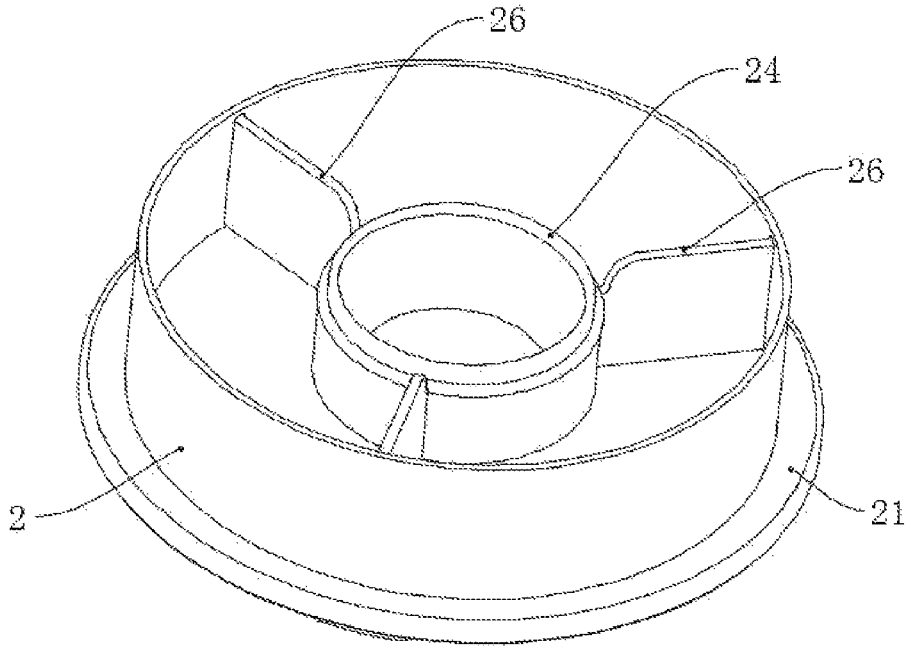
FIG. 5 is a top stereographic view of a sandwich box body of a multi-functional double-layer crisper of the present invention.

To further optimize the above technical solution, as shown in FIG. 4 and FIG. 5, the partition plates comprise an annular partition plate 24 and rectangular partition plates 26, the vertically arranged annular partition plate 24 is installed in the inner middle position of the sandwich box body 2, the plurality of vertically arranged rectangular partition plates 26 are installed along the circumferential direction between the outer wall of the annular partition plate 24 and the inner wall of the sandwich box body 2, and the inner part of the sandwich box body 2 is divided into a plurality of containing cavities by the annular partition plate 24 and the rectangular partition plates 26; and a seasoning box 6 is installed in the annular partition plate 24.

Figure 2:
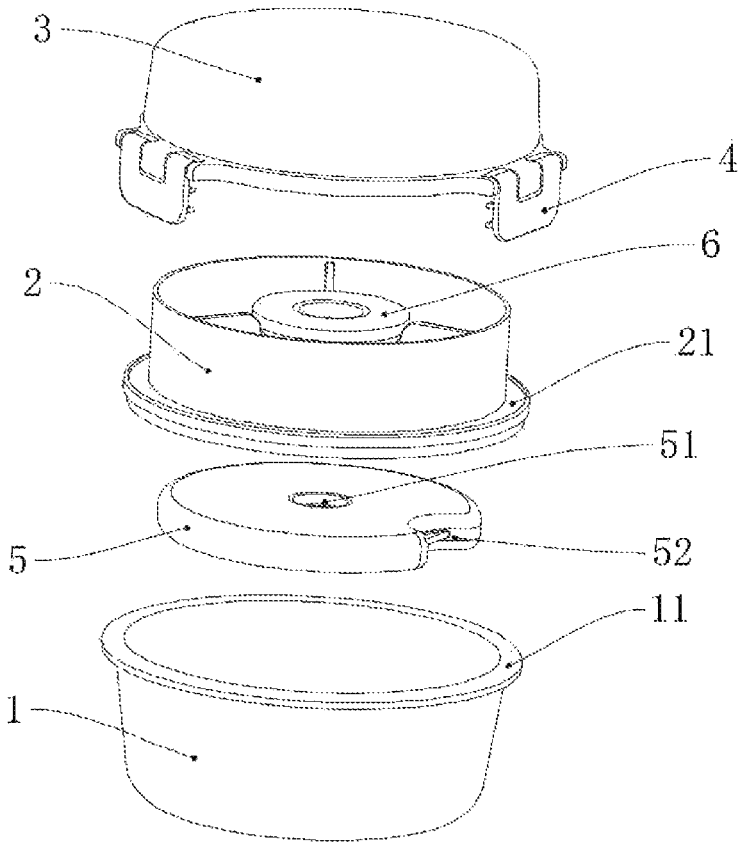
FIG. 2 is an explosive view of a multi-functional double-layer crisper of the present invention.

To further optimize the above technical solution, as shown in FIG. 2, FIG. 4 and FIG. 6, the middle part of the bottom surface of the containing groove 22 is protruded downwards to form a clamping block 25, the middle part of the insulation ice box 5 is provided with a clamping hole 51 penetrating the insulation ice box 5, and the outer wall of the clamping block 25 is clamped and fixed with the inner wall of the clamping hole; and the peripheral edge of the insulation ice box 5 is concave inwards to form a curved groove 52. The clamping block 25 has a hollow ring structure.

To further optimize the above technical solution, the bottom box body 1 is made of high borosilicate glass material, and the sandwich box body 2 and the cover body 3 are made of PP material.

To further optimize the above technical solution, as shown in FIG. 1, FIG. 2, FIG. 9 and FIG. 10, the sections of the bottom box body 1, the sandwich box body 2 and the cover body 3 along the horizontal direction all have a rectangular or circular structure.

When the multi-functional double-layer insulation ice box of the present invention is used, the sandwich box body 2 is placed above the bottom box body 1, and the upper end face of the annular flange 11 and the lower end face of the annular clamp plate 21 are sealed by the seal ring 7; the opening end of the cover body 3 is downwards buckled on the sandwich box body 2, the sandwich box body 2 is located in the cavity of the cover body 3, and the opening end and the inner top surface of the cavity of the cover body 3 are sealed by the sealing ring 7; the upper end face of the annular clamp plate 21 is protruded to form a limiting bulge, the opening end face of the cover body 3 is provided with a limiting groove matched with the limiting bulge, and the opening end of the cover body 3 is limited by the limiting groove and the limiting bulge of the annular clamp plate 21 to avoid misalignment;

The annular partition plate 24 and the rectangular partition plates 26 are installed in the sandwich box body 2, and the seasoning box 6 is placed in the annular partition plate 24; and the insulation ice box 5 is clamped in the containing groove 22 on the bottom end of the sandwich box body 2, and the upper end face of the insulation ice box 5 is abutted with the bottom surface of the containing groove 22, which is convenient for assembly and disassembly through the curved groove 52;

The outer edge of the opening end of the cover body 3 is hinged with a plurality of knuckles 4; when the sandwich box body 2 is installed, the second clamping plates 44 of the knuckles 4 are clamped with the annular flange 11 of the bottom box body 1, and the first clamping plates 43 can limit the side wall of the annular clamp plate 21 of the sandwich box body 2; and when it is not necessary to install the sandwich box body 2, the first clamping plates 43 of the knuckles 4 are clamped with the annular flange 11 of the bottom box body 1.

In a specific embodiment, as shown in FIG. 1 and FIG. 2, the multi-functional double-layer crisper of the embodiment is circular, the sections of the bottom box body 1, the sandwich box body 2 and the cover body 3 along the horizontal direction all have a circular structure, and the insulation ice box 6 has a circular structure.

Figure 9:
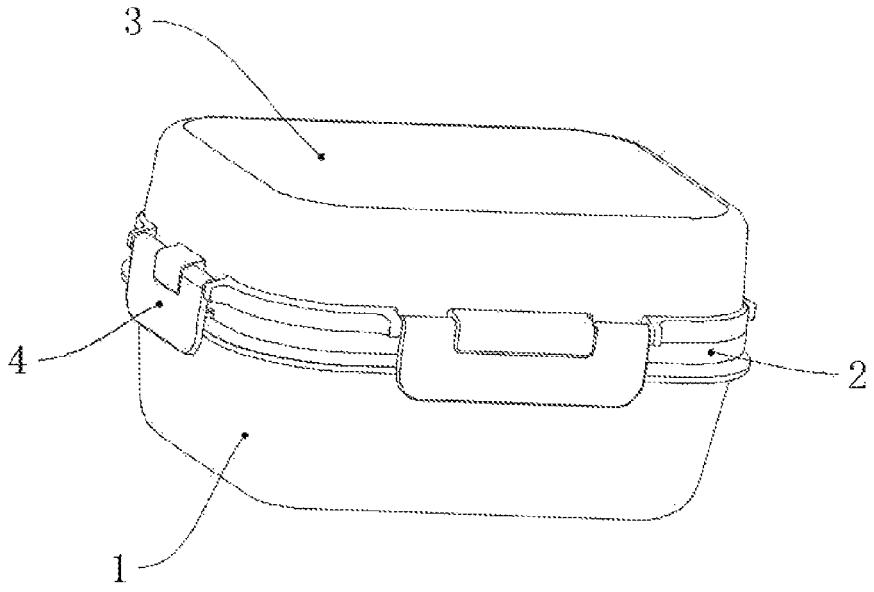
FIG. 9 is an integral structural schematic diagram of another specific embodiment of a multi-functional double-layer crisper of the present invention.
Figure 10:
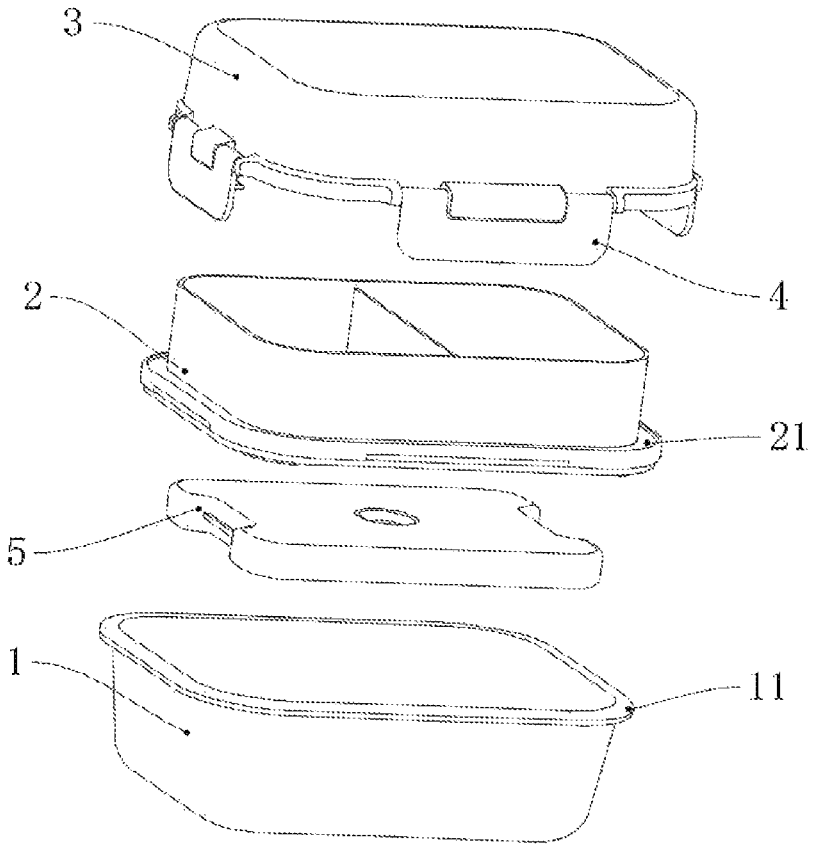
FIG. 10 is an explosive view of FIG. 9.

In another specific embodiment, as shown in FIG. 9 and FIG. 10, the multi-functional double-layer crisper of the embodiment is rectangular, the sections of the bottom box body 1, the sandwich box body 2 and the cover body 3 along the horizontal direction all have a rectangular structure, and the insulation ice box 6 has a rectangular structure.

The above is just preferred embodiments of the present invention and is not intended to limit the present invention. Any modification, equivalent replacement, improvement, etc. made within the spirit and the principle of the present invention shall be contained within the protection scope of the present invention.

What is claimed is:

1. A multi-functional double-layer crisper, comprising: a bottom box body (1), wherein a top end of the bottom box body (1) is open, and an edge of an opening end is protruded outwards to form an annular flange (11); a sandwich box body (2), wherein a top end of the sandwich box body (2) is open, an edge of a bottom end is protruded outwards to form an annular clamp plate (21), and a lower end face of the annular clamp plate (21) is hermetically abutted with an upper end face of the annular flange (11); and the sandwich box body (2) is internally provided with partition plates vertical to a bottom wall and divided into independent containing cavities, an outer bottom end face of the sandwich box body (2) is concave inwards to form a containing groove (22), and an insulation ice box (5) is clamped in the containing groove (22); a cover body (3), wherein an inner part of the cover body (3) is a cavity with an opening on the bottom end, and an outer edge of a opening end is hinged with a plurality of knuckles (4) along a circumferential direction; the cavity of the cover body (3) is buckled on an outer side of the sandwich box body (2), an opening end face is abutted with an upper end face of the annular clamp plate (21), and an inner top surface of the cavity of the cover body (3) is hermetically abutted with an opening end face of the sandwich box body (2); and each knuckle (4) is provided with first clamping plates (43) and second clamping plates (44) arranged up and down at intervals, and the first clamping plates (43) and the second clamping plates (44) can be clamped and fixed with the annular flange (11); wherein a position of a bottom end face of the sandwich box body (2) near an edge is protruded downwards to form a plurality of limiting plates (27).

2. The multi-functional double-layer crisper according to claim 1, wherein a position of an outer edge of an opening end of the cover body (3) corresponding to each knuckle (4) is protruded outwards to form a raised clamping structure; the raised clamping structure comprises a first bump (31), a second bump (32) and a third bump (33), the second bump (32) has an L-shaped section and is located between the first bump (31) and the third bump (33), two articulated grooves are limited between the second bump (32) and the first bump (31) and between the second bump (32) and the third bump (33), articulated shafts (34) are respectively installed in the articulated grooves, and the knuckles (4) are hinged with the articulated shafts (34).

3. The multi-functional double-layer crisper according to claim 2, wherein each knuckle (4) comprises articulated parts (41) and a connecting plate (42), each articulated part (41) has a ring structure with the section greater than a ½ circle, and the lower end of each articulated part (41) is integrally connected with the connecting plate (42) extending downwards; a positions of the articulated parts (41) and the connecting plate (42) corresponding to the second bump (32) are concave to form an avoidance groove, and the articulated parts (41) on both sides of the avoidance groove are respectively sleeved and hinged with the articulated shafts (34); and an inner side of the connecting plate (42) is integrally connected with the first clamping plates (43) and the second clamping plates (44) arranged up and down at intervals.

4. The multi-functional double-layer crisper according to claim 3, wherein upper end faces of the first clamping plates (43) and the second clamping plates (44) are protruded to form buckles, and a lower end face of the annular flange (11) is concave to form clamping grooves matched with the buckles.

5. The multi-functional double-layer crisper according to claim 1, wherein a first sealing groove (23) is formed on a lower end face of the annular clamp plate (21), and a seal ring (7) is installed in the first sealing groove (23) and hermetically abutted with the upper end face of the annular flange (11); and a second sealing groove is formed on the inner top surface of the cavity of the cover body (3), and the seal ring (7) is installed in the second sealing groove and hermetically abutted with the opening end face of the sandwich box body (2).

6. The multi-functional double-layer crisper according to claim 1, wherein the partition plates comprise an annular partition plate (24) and rectangular partition plates (26), a vertically arranged annular partition plate (24) is installed in an inner middle position of the sandwich box body (2), a vertically arranged rectangular partition plates (26) are installed along a circumferential direction between an outer wall of the annular partition plate (24) and an inner wall of the sandwich box body (2), and the inner part of the sandwich box body (2) is divided into the plurality of containing cavities by the annular partition plate (24) and the rectangular partition plates (26); and a seasoning box (6) is installed in the annular partition plate (24).

7. The multi-functional double-layer crisper according to claim 1, wherein a middle part of a bottom surface of the containing groove (22) is protruded downwards to form a clamping block (25), a middle part of the insulation ice box (5) is provided with a clamping hole (51) penetrating the insulation ice box (5), and an outer wall of the clamping block (25) is clamped and fixed with an inner wall of the clamping hole; and a peripheral edge of the insulation ice box (5) is concave inwards to form a curved groove (52).

8. The multi-functional double-layer crisper according to claim 1, wherein the bottom box body (1) is made of high borosilicate glass material, and the sandwich box body (2) and the cover body (3) are made of PP material.

9. The multi-functional double-layer crisper according to claim 1, wherein the sections of the bottom box body (1), the sandwich box body (2) and the cover body (3) along a horizontal direction all have a rectangular or circular structure.

* * * * *